United States Patent [19]

Putnam, Jr. et al.

[11] 4,085,567

[45] Apr. 25, 1978

[54] HIGH SPEED WRAPPING MACHINE WITH ROTARY FOLDER

[75] Inventors: Roger L. Putnam, Jr., East Longmeadow; Richard H. Provost, Brimfield; Alfred D'Antonio, East Longmeadow, all of Mass.

[73] Assignee: Package Machinery Company, East Longmeadow, Mass.

[21] Appl. No.: 699,518

[22] Filed: Jun. 24, 1976

[51] Int. Cl.[2] ..... B65B 11/28

[52] U.S. Cl. ..... 53/225; 53/226; 53/380

[58] Field of Search ..... 53/225, 234, 226, 380

[56] References Cited

U.S. PATENT DOCUMENTS

| | | | |
|---|---|---|---|
| 762,255 | 6/1904 | Rose | 53/225 X |
| 879,544 | 2/1908 | Hicks | 53/234 |
| 1,178,246 | 4/1916 | Linker | 53/234 |
| 2,627,709 | 2/1953 | Schlicksupp | 53/225 X |
| 2,627,710 | 2/1953 | Hohl | 53/234 |
| 3,136,104 | 6/1964 | Geer | 53/234 |
| 3,139,716 | 7/1964 | Turnbull | 53/380 |
| 3,439,473 | 4/1969 | Focke | 53/234 |
| 3,688,472 | 9/1972 | Revaz | 53/225 |

FOREIGN PATENT DOCUMENTS

| | | | |
|---|---|---|---|
| 809,862 | 3/1959 | United Kingdom | 53/225 |

*Primary Examiner*—Othell M. Simpson
*Assistant Examiner*—John Sipos
*Attorney, Agent, or Firm*—McCormick, Paulding & Huber

[57] ABSTRACT

A high speed wrapping machine designed to wrap individual tablet-like products utilizes a wrapping wheel having a plurality of peripheral pockets into which the individual products are moved in the axial direction to drape a panel of wrapping material snuggly over the product. A rotary folding mechanism is situated adjacent the periphery of the wrapping wheel and tucks and folds panel portions extending axially from the pocket against the product as the product moves past the folding mechanism. The rotary folding mechanism is comprised of two rotors, each of which has a plurality of folding blades, and which rotate adjacent the pockets at one side of the wrapping wheel in synchronized relationship. The rotors have spaced and parallel axes of rotation, both of which are located outside the periphery of the wrapping wheel.

18 Claims, 22 Drawing Figures

HIGH SPEED WRAPPING MACHINE WITH ROTARY FOLDER

BACKGROUND OF THE INVENTION

The present invention relates to packaging machinery and more particularly, relates to high speed packaging machinery for wrapping individual products such as tablets, food products, small boxed goods and the like.

The state of the art in package machinery has progressed to the point where high speed wrapping of individual products is matched with the mass production rate of the products. In order to handle a high volume of small products at the rate in which they are produced, the packaging machinery is generally in continuous motion as opposed to earlier prior art packaging machines characterized by intermittent motion. For example, U.S. Pat. No. 1,392,683 utilizes a pocket wheel which has a plurality of peripheral pockets into which a candy or other product is moved axially of the wheel by means of a set of plungers disposed perpendicular to the plane of the wheel. A wrapper panel is placed over the candy before it is moved into the pocket so that the movement of the candy and wrapper together through an aperture drapes the wrapper over the product. Panel protions extending beyond the pocket are then tucked and folded against the product in the final stages of the wrapping operation. Since the plungers which move the product through a pocket in the periphery of the wheel are fixedly mounted at one point along the periphery of the wheel, the wheel must be momentarily stopped as the product is moved and the wrapping operation is carried out.

Wrapping machines which use intermittently operated wrapping wheels generally have a relatively low production rate. A substantial degree of time and energy is lost in accelerating and decelerating the product between each wrapping of a product. Additionally, the rate at which the product can be accelerated or decelerated may impose additional restraints upon the speed of the wrapping operation even though the machine itself is capable of higher speeds.

U.S. Pat. No. 3,136,104 points out the advantage of higher wrapping speeds permitted by continuously rather than intermittently rotated wrapping wheels. In this patent and in U.S. Pat. No. 1,178,246 the pockets of a wrapping wheel open radially to receive a product. Plungers such as the type shown in U.S. Pat. No. 1,392,683 described above are not utilized and hence the intermittent motion of the wrapping wheels is obviated.

A further advantage of the continuously rotating wrapping wheels is that they permit the use of a rotary folding mechanism that is simpler in construction and faster in operation. Both of the above-identified U.S. Pat. Nos. 1,178,246 and 3,136,104 illustrate rotary folding mechanisms, which include a plurality of folding blades that rotate about an axis situated radially outside of the pockets in the wrapping wheel. The blades are rotated in synchronism with the pockets of the wheel and extend into overlapping relationship with the pockets at the mergence of the blades and wheel. The blades by their operation tuck and fold extending portions of the wrapper panel against the product as it is carried past the rotor toward a discharge point at a further station around the wrapping wheel. The rotary folding mechanisms are completely compatible with the continuously rotating wrapping wheels and are specially suited to high speed operation because of the pure rotational movement of the folding blades which carry out the tucking and folding operations on the wrapper panel. As a result of the rotary motions, inertia forces are very low and, thus, high speed processing of the products is made possible.

It is a general object of the present invention to provide a wrapping machine utilizing a continuously rotating wrapping wheel in order to obtain high speed operation and a correspondingly high production rate. It is a further object of the present invention to provide a high speed wrapping machine capable of handling small individual products such as tablets, food products and the like with a capacity in the order of 1800 pieces per minute.

SUMMARY OF THE INVENTION

The present invention resides in a high speed wrapping machine for handling individual articles at a high production rate.

The machine is comprised of a rotatable wrapping wheel having a plurality of product-receiving pockets distributed around the periphery of the wheel. Each of the pockets receives one product at one point along the periphery and discharges the wrapped product at another point. At the receiving point, the product is moved axially of the wheel into a pocket by means of a set of plungers associated with the pocket and disposed for revolving movement with the wrapping wheel. A wrapper feed mechanism delivers individual wrapper panels to one side of the wheel between a respective pocket and one of the plungers while a product feed means delivers the product to the same side of the wheel between the individual wrapper panel and the plunger. The plunger then moves the product and wrapper panel axially into the associated pocket at which time the wrapper is draped over the product so that panel portions extend from the pocket at one side of the wheel.

With the product and wrapper panel positioned in a pocket, the wrapping wheel translates the pocket past a rotary folding means positioned adjacent the periphery of the wrapping wheel. A plurality of folding blades comprising part of the folding means tuck at least some of the extending panel portions against the product. The rotary folding means in one embodiment is comprised of two different-bladed rotors mounted on spaced and parallel axes extending parallel to the axis of the wrapping wheel. The rotor axes are situated outside the path traveled by the pockets of the wrapping wheel by amounts permitting the blades to sweep into contact with the extending panel portions and fold the panel portions within the region of mergence of the rotors and wheel. Mounting the folding blades on rotors having spaced axes permits different angles and rotational speeds of the blades to be utilized in the folding operation.

DESCRIPTION OF THE PREFERRED EMBODIMENTS

Figure 1:
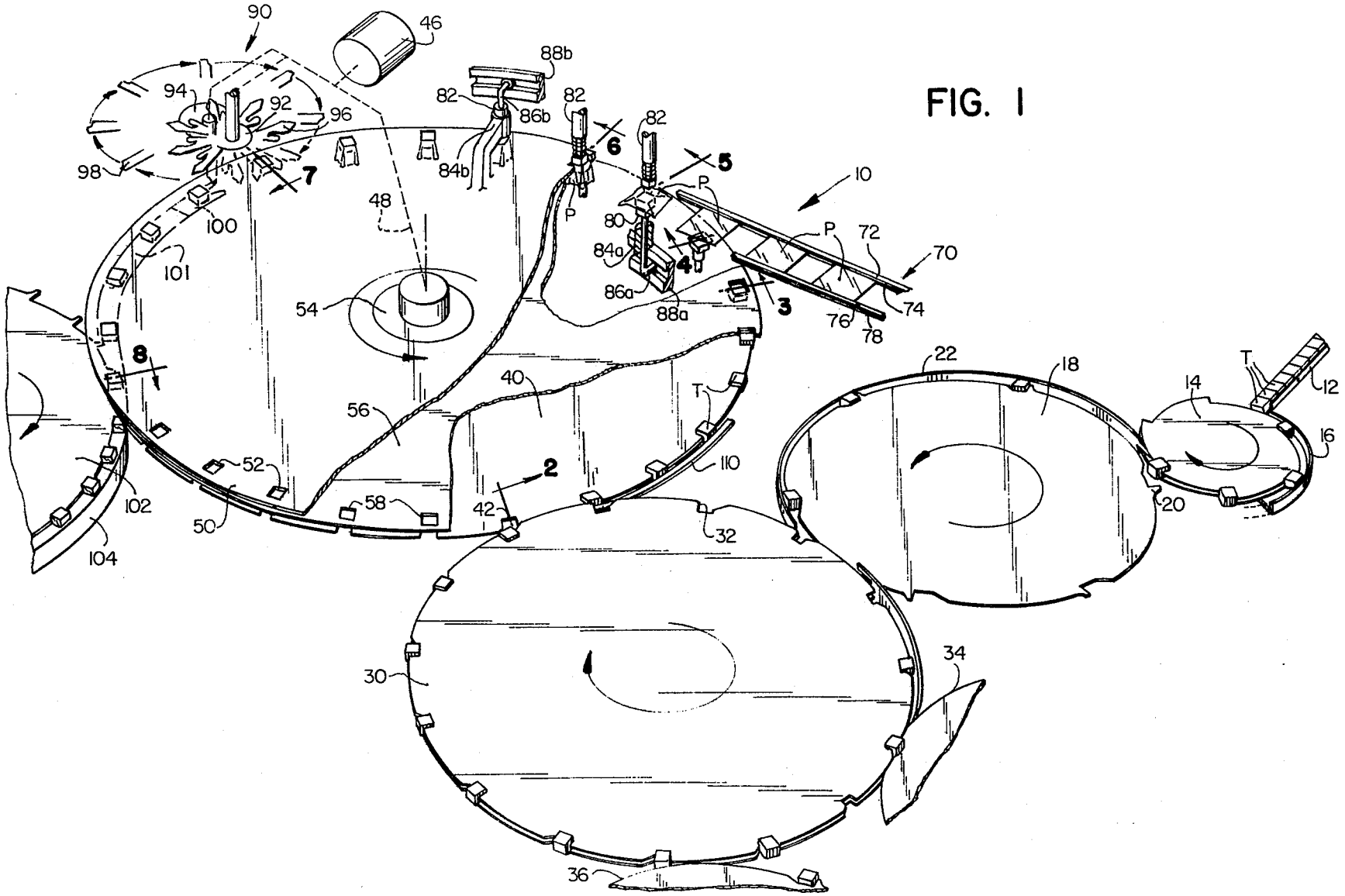
FIG. 1 is a perspective view of the high speed wrapping machine of the present invention and illustrates the various components of the machine and their positional relationship.

FIG. 1 illustrates the principal components of the high speed wrapping machine of the present invention in one embodiment. The wrapping machine, generally designated 10, is shown and described as a machine for individually wrapping rectangularly shaped tablets; however, it should be understood that the utility of the machine is not limited to such a product and that various other products such as food stuffs, small boxes and the like can be wrapped in accordance with this invention.

FIG. 1 shows rectangular tablets T being fed to the wrapping machine from a slide 12 having a discharging end at the periphery of a continuously rotating pick-up wheel 14. The slide may lead from a feeder bowl of another machine which produces the tablets. The pick-up wheel 14 has a plurality of rachet-shaped teeth distributed about its periphery which teeth pick up individual tables from the slide 12 and carry them in an arcuate path to the mergence of the pick-up wheel 14 and an accelerating wheel 18. An angularly shaped guide track or retainer 16 supports the tablets captured by the rachet teeth and holds the tablets in the teeth as the wheel rotates.

The pick-up wheel 14 is a female-type wheel comprised of two spaced plates while the accelerating wheel 18 is a male-type wheel made from single plate that is slightly thinner than and fits between the two plates of the pick-up wheel. The periphery of the accelerating wheel 18 defines a plurality of pockets and a small projection 20 adjacent the trailing edge of each pocket. At the mergence of the pick-up wheel 14 and the accelerating wheel 18, the projection 20 extends between the two plates of the wheel 14 and by coordinating the direction and the speed of rotation of the two wheels, a tablet is removed from the pick-up wheel and is transferred into the pocket of the accelerating wheel. A retainer 22 which is continuous with and similar to the retainer 16 circumscribes approximately half of the periphery of the accelerating wheel 18 to provide a track for the tablets as they are carried by the accelerating wheel. At the mergence of the pick-up and accelerating wheels, the side wall of the retainer 22 takes the shape of a finger which projects between the two plates of the pick-up wheel and serves as a stripper to ensure that the tablet T is transferred from one wheel to the other.

It will be understood that the pick-up wheel 14 could be a male-type wheel comprised of a single plate and that the accelerating wheel correspondingly could be a female wheel straddling the pick-up wheel at their mergence. Also, the retainers 16 and 22 would be appropriately shaped to transfer the tablets between these two wheels at their mergence.

A synchronized rotational drive mechanism comprised of a gear train (not shown) is connected to the pickup-wheel 14 and the accelerating wheel 18 to drive the wheels at the same angular or rotational speeds. The drive mechanism holds the wheels in a fixed phased relationship and since there are six pockets on the wheel 18 and six teeth on the wheel 14, the pockets and teeth always mate to transfer the tablets. However, the accelerating wheel has a larger diameter than the pick-up wheel and consequently, a higher peripheral speed to remove a tablet from the wheel 14. The speed of the tablet is thus progressively increased as it is removed from the slide 12 and transferred to the accelerating wheel 18.

An accumulating wheel 30 of the female-type is situated generally tangent to the accelerating wheel 18 and is provided with a plurality of pockets 32 at its periphery for receiving the tablets from the accelerating wheel 18 and preferably additional accelerating wheels 34 and 36. The accelerating wheels and accumulating wheel are male- and female-type wheels respectively to permit a limited degree of overlap at their mergence, and retainers (not shown) similar to the retainers 16 and 22 are used to insure transfer to the accumulating wheel. Thus, the accumulating wheel 30 may, for example, be provided with three times as many pockets as the accelerating wheel 18 so that three accelerating wheels situated at three different stations about the accumulating wheel are required to fill all of the pockets. The synchronized drive mechanism associated with the accelerating wheels is also connected to the accumulating wheel 30 to maintain synchronous rotation and a desired phase relationship. With three accelerating wheels, the accumulating wheel 30 is driven at such rotational speed that the tablets T being transferred from the accelerating wheels 18 are placed in every third pocket 32 of the accumulator wheel 30. By driving the accumulating wheel 30 at approximately the same rotational speed as the accelerating wheels and inserting the respective tablets from each accelerating wheel into every third pocket respectively of the accumulator wheel 30, the tablets are accelerated by a further increment.

A plunger feed wheel or retaining wheel 40 having peripherally opening pockets 42 receives the tablets T from the accumulating wheel 30 with the aid of a stripper 110 and a support plate 112. The retaining wheel 40 is driven about a vertical axis by the shaft 44, a drive motor 46 and drive train 48, which is preferably the same synchronous drive mechanism rotating the other wheels 14, 18 and 30. The diameter and speed of rotation of the retaining wheel may be selected to provide a further increase in the speed of the tablets as desired. Thus, between the slide 12 and the retaining wheel 40, the tablets can be accelerated to speeds of, for example, 90 inches per second without damage to the product itself or to the series of wheels feeding the tablets to the retaining wheel 40.

The principal wrapping operations are carried out in connection with a wrapping wheel 50 which is mounted coaxially above the retaining wheel 40 on a common hub 54 and thus is coupled directly to the wheel 40 to rotate at the same speed. The wrapping wheel has a plurality of pockets 52 distributed evenly about the periphery of the wheel in alignment with the pockets 42 of the retaining wheel 40. The pockets extend through the wheel from one axial end face or side to the other along axes parallel to the axis of the wheel 50 and thus have openings at each face of the wheel. Unlike the retaining wheel 40, the pockets 52 do not open radially and are bound by four rectangularly arranged sides. The rectangular shape of the pockets is slightly larger than the rectangular tablet T handled by the machine 10.

Interposed between the wrapping wheel 50 and the retaining wheel 40 is a wrapped forming disc 56 which is similar to the wrapping wheel 52 in that it contains a plurality of axially open apertures 58 at its periphery. The apertures 58 are aligned with the pockets 42 and 52 in the retaining wheel and wrapping wheel. The function of the forming disc 56 is described in greater detail below.

A wrapper feed mechanism 70 delivers pre-cut rectangular panels P of a wrapping material to the periphery of the wrapping wheel 50 along a feed path which extends generally tangentially of the circular path traveled by the pockets 52. The feed mechanism in the illustrated embodiment is comprised of two sets of feed belts 72, 74 and 76, 78 between which the wrapper panels P are clamped. The belts 72 and 74 clamp the several panels along one side, and the belts 76 and 78 clamp the panels along the opposite, parallel side. As described in greater detail below, the feed belts deliver the wrapper panels to positions under the pocket 52 of the wrapping wheel between the forming disc 56 and the retaining wheel 40.

To this end the belts 72 and 74 extend outside of the periphery of the wrapping wheel 50 beyond the point of tangency, that is, the point at which the pockets 52 and belts move in the same direction. In the preferred embodiment of the invention, the belts 76 and 78 are shorter and extend to a point which closely approaches the periphery of the disc 56 at which point they separate and relese the edge of the wrapper panel located closest to the wrapping wheel. The longer belts 72 and 74 carry the panel into the point of tangency where the panel is stripped from between the belts. It will be understood that other types of wrapper feed mechanisms which produce pre-cut wrapper panels may be used to deliver the panels to the point of tangency below a pocket 52 and between the retaining wheel 40 and the forming disc 56. For example, if a dead plate is positioned parallel to the belts 72 and 74 and under the wrapper panels as the panels approach the disc 56, the belts 76 and 78 may be eliminated entirely.

After the tablets T are transferred to the pockets 42 of the retaining wheel 40 from the accumulating wheel they move underneath a wrapper panel P at the point of tangency, and a set of cam-operated plungers 80, 82 revolving with the wheels 40 and 50 and associated with a selected pair of aligned pockets 42 and 52 cause the tablet and the wrapper to move upwardly through the aperture 58 in the forming disc 56 and into the pocket 52 of the wrapping wheel 50. The wrapper is at that time draped over the tablet with portions of the panel extending axially downward from the four sides of the pocket. The lower plunger 80 is carried in a housing **84*a* which is connected to the retaining wheel 40. The lower end of the plunger has a cam follower 86*a* which engages a groove in a stationary cam 88*a* to control the reciprocation of the plunger 80 in the housing 84*a*. In a similar manner, the upper plunger 82 is supported in a housing 84*b* connected to the wrapping wheel 50 and is reciprocated by a cam follower 86*b* and stationary cam 88*b***.

Continued movement of the tablet T and draped panel P in the pocket 52, brings the extending panel portions into contact with a rotary folder 90 which tucks and folds at least some of the extending panel portions against the underside of the tablet. The rotary folder in a preferred embodiment of the invention is comprised of two rotors 92 and 94 which are rotated about spaced axes that extend parallel to the axis of rotation of the wrapping wheel 50. A set of folding blades 96 on the rotor 92 and another set of folding blades 98 on the rotor 94 engage the extending panel portions to accomplish the folding operations.

Further movement of the tablet causes the cam-operated plunger 82 to depress the tablet slightly from the pocket 52 onto a last folder blade 100 which completes the folding operation. Further movement of the tablet beyond the last folder blade causes the plunger 82 to eject the folder tablet onto the takeout plate 101. The tablets are then transferred to a discharge wheel 102 where a heat plate 104 may permanently set the folds developed by the mechanism 90. The wrapped tablets may then be transmitted to grouping mechanisms for higher level packaging or may be deposited in bulk containers.

The wrapping operations performed along the periphery of the wrapping wheel 50 are described in greater detail in connection with FIGS. 2–8. The stations at which the operations in these figures are performed are identified on the wrapping wheel in FIG. 1 by section lines corresponding numerically to the figures.

Figure 2:
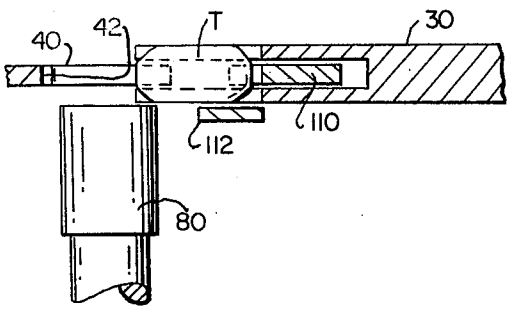
FIGS. 2–8 are a series of fragmentary sectional views of the wrapping machine taken through pockets in the wrapping wheel and show the various positions of one product as it progresses through a wrapping operation.

FIG. 2 illustrates the position of the tablet T at the mergence of the accumulating wheel 30 and the retaining wheel 40. The accumulating wheel 30 is a female-type and thus the stripper 110 projects between the wheel flanges to capture the tablet. The stripper becomes a retainer which follows the periphery of the plunger wheel in the same manner as the retainer 22 in FIG. 1. A support plate 112 below the accumulating wheel 30 follows the path traveled by the pockets 32 to hold the tablet in the plane of the wheel 30 until the convergence with and subsequent transfer of the tablet into the retaining wheel 40. The tablet is then held in a pocket 42 of the retaining wheel at the same plane by the lower plunger head 80.

Figure 3:
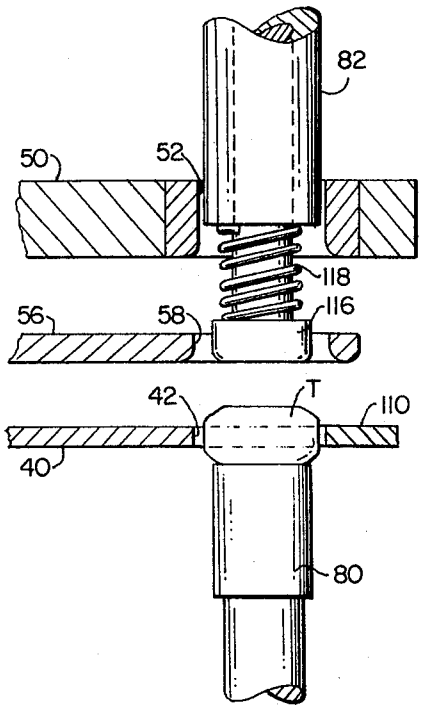

FIG. 3 illustrates the positioning of the tablet T within the pocket 42 of the retaining wheel 40 at a point beyond the mergence of the accumulating and retaining wheels. It will be noted that the retainer 110 prevents the tablet from shifting radially outward of the open side of the pocket. The upper plunger 82 is lowered to a point at which the depending head 116 biased downwardly by the spring 118 is within the aperture 58 of the forming disc 56 and flush with the lower surface of the disc.

Figure 4:
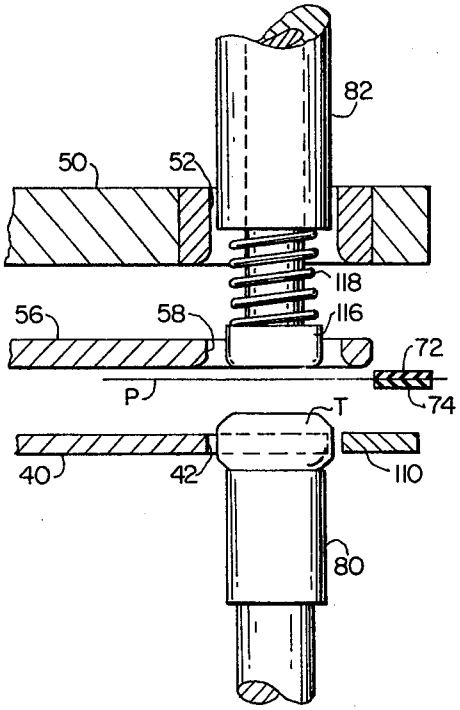

FIG. 4 is a sectional view of the machine at the station along the wrapping wheel where the wrapper feed mechanism introduces the wrapper panel P between the forming disc 56 and the tablet T in the retaining wheel 40. It will be noted that at this point, the wrapper panel P is clamped along one edge only by the belts 72 and 74 outside of the periphery of the disc 56. The belts 72 and 74 maintain the positional orientation of the rectangular panel P and move the panel at the same speed as the tablet.

Figure 5:
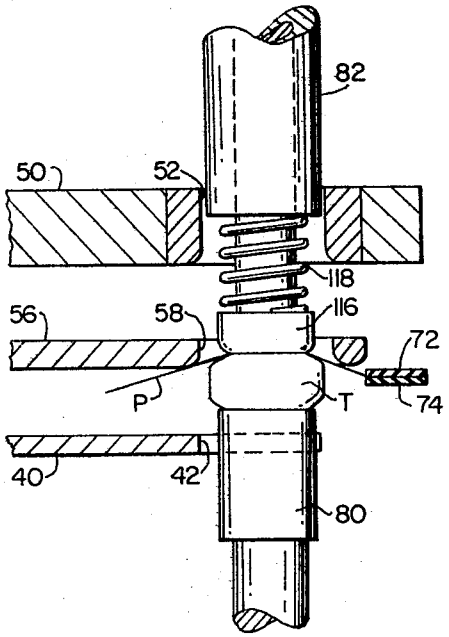

As the tablet T and wrapper panel P approach the station corresponding to FIG. 5, the lower plunger 80 is lifted by the cam 88 in FIG. 1 so that the tablet moves upwardly axially of the aperture 58 in the forming disc 56 and begins to push the panel P through the forming aperture in the disc. At the same time, contact is made with the head 116 of the upper plunger 82 so that the panel is clamped between the upper side of the tablet and the head. Continued movement of the plunger 80 and tablet causes the panel to be drawn over the tablet by the lower contoured edges of the aperture 58.

As the point of tangency along the wrapping wheel 50 and wrapper feed path is reached, the pressure developed along the one side of the rectangular panel P by the belts 72 and 74 is relaxed slightly by appropriate positioning of the pulleys which carry the belts so that the panel is released when the rectangular sides of the panel are generally parallel to the rectangular sides of the forming aperture 58. Thus, as the tablet moves through the aperture 58, the panel P is centered over the tablet T with substantially equal portions of the panel draped over the tablet generally parallel to the respective sides of the rectangular aperture 58.

Figure 6:
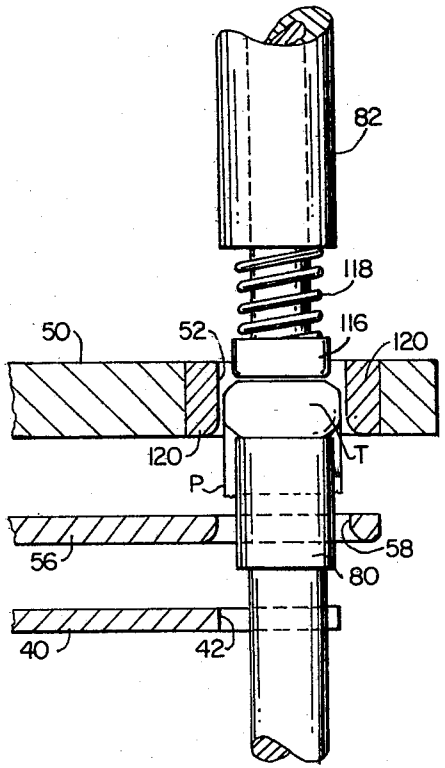

FIG. 6 illustrates the tablet T after it has passed through the aperture 58 in the forming disc 56 and upwardly on the plunger 80 into a pocket 52 of the wrapping wheel 50. As the tablet and the panel move upwardly into the aperture 52 which is slightly larger than the tablet, the side portions of the panel are creased and folded downwardly over the sides of the tablet so they project axially from corresponding sides of the rectangular pocket 52. The upper plunger 82 has also moved upward slightly more than the nominal thickness of tablet to ensure that no downward pressure is exerted on the tablet as it subsequently moves into the rotary folding mechanism.

It may be desirable to position resilient fingers within the pocket 52 to hold the draped portions of the wrapper panel against the tablet and to also insure that the tablet is held snugly within the pocket. Such fingers may be formed by leaf springs or the side walls 120 of the pocket may be formed by resiliently mounted plates or bristle-type materials.

Figure 7:
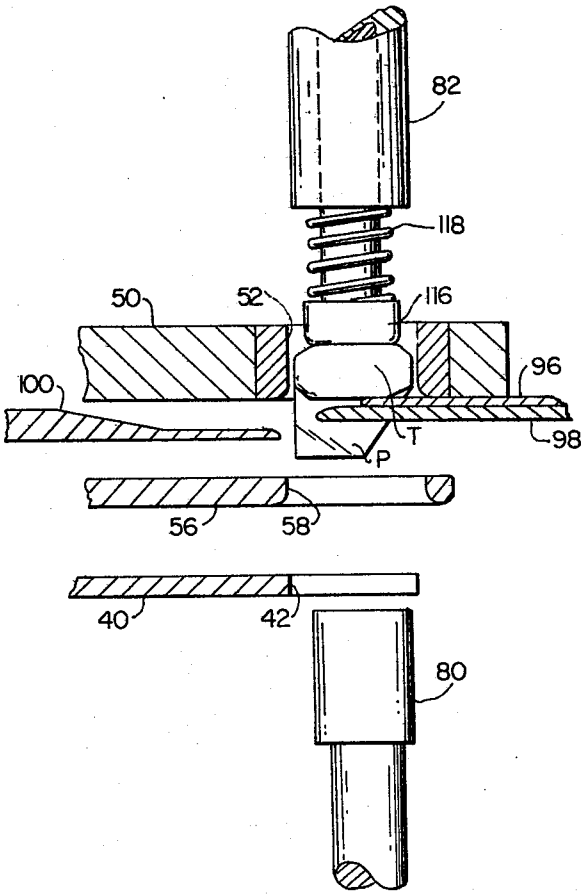

FIG. 7 illustrates the tablet T within the wrapping wheel 50 as the axially extending side portions of the panel P are folded by the rotary folding mechanism 90. The folding blades 96 and 98 of the two rotors comprising the folding mechanism 90 sweep across the extended panel portions as described in greater detail with respect to FIGS. 11–20 to fold the panel portions against the underside of the tablet. It will be observed that the lower plunger 80 has been withdrawn to provide clearance for the folding blades and that the upper plunger 82 has been repositioned downward to ensure that the tablet remains wedged within the pocket 52 generally flush with the bottom or lower axial end face of the wrapping wheel 50. In the preferred embodiment of the invention, the rotary folding mechanism folds the panel portions extending from three sides of the rectangular pocket 52 against the tablet, and thereafter the stationary last folder blade 100 folds the remaining portion at the leading side of the pocket.

Figure 9:
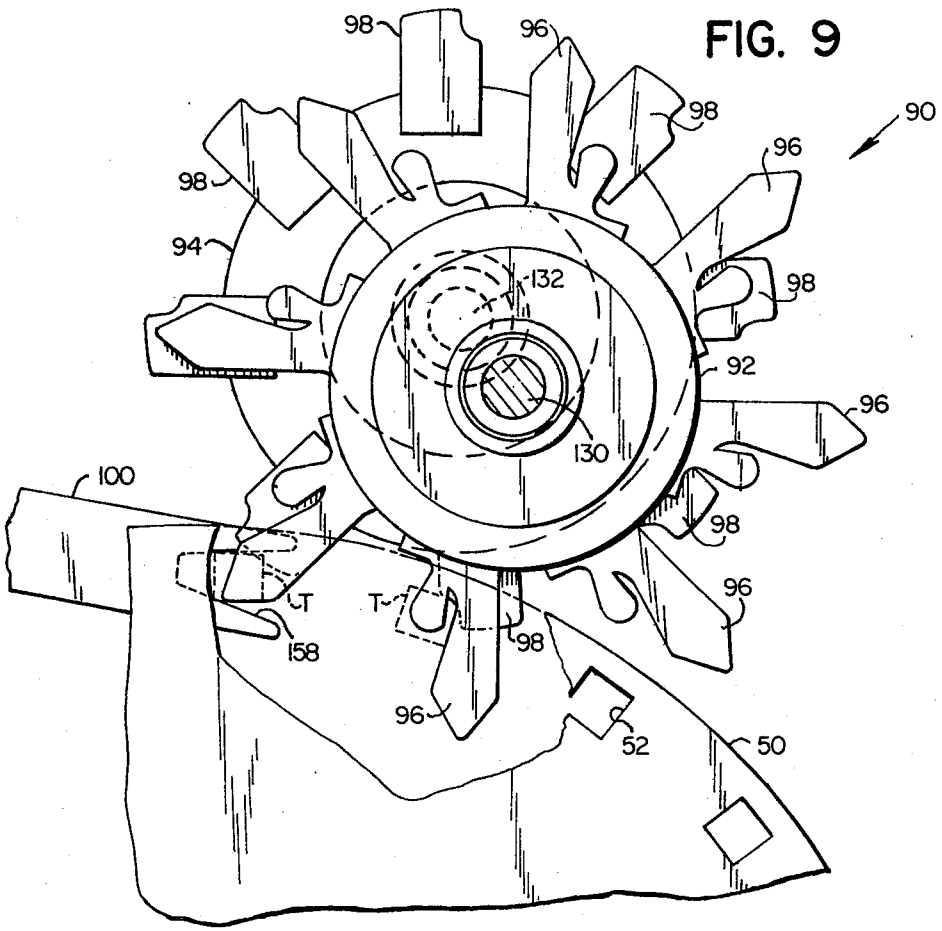
FIG. 9 is a plan view of the rotary folding mechanism which cooperates with the wrapping wheel to complete one stage of the wrapping operation.
Figure 10:
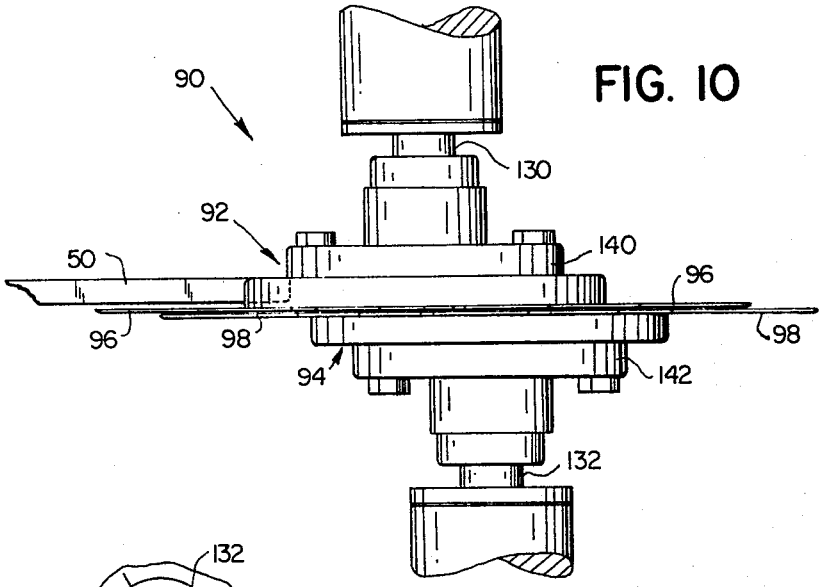
FIG. 10 is a side elevation view of the rotary folding mechanism in FIG. 9.

FIGS. 9 and 10 illustrate the construction of the rotary folding mechanism 90 in detail. As described above, in connection with FIG. 1, the folding mechanism 90 is comprised of a first rotor 92 having a plurality of folding blades 96 and a second rotor 94 having a plurality of folding blades 98. The first rotor 92 is fixedly attached to the lower end of a drive shaft 130 extending downwardly from above the plane of the wrapping wheel 50. The second rotor 94 is supported immediately below the first rotor on the upper end of another drive shaft 132. A finite clearance, for example, 1/32nd of an inch, is maintained between the blades of the two rotors and this clearance should be made as small as possible since ideally one blade on each rotor should sweep across the bottom side of the tablet in the same plane. The axis of the drive shaft 130 is situated outside of the periphery of the pockets in the wrapping wheel 50 and extends parallel to the axis of the wheel. The axis of the drive shaft 132 is also situated outside of the periphery of the wrapping wheel and is spaced in parallel relationship with the shaft 130. Both shafts 130 and 132 are driven at the same rotational speed by the drive motor 46 in FIG. 1 that rotates the wrapping wheel and the feed wheels.

The rotor 92 has a hub 140 fixed to the shaft 130 and serves as the mount for the plurality of folding blades 96. Similarly, the rotor 94 has a hub 142 which is fixedly secured to the shaft 132 and serves as the mount for the folding blades 98. Since the drive shaft 132 is located at a greater distance from the pockets in the wrapping wheel and is also located along a different radial of the wrapping wheel than the shaft 130, and blades 96 and 98 rotate across the extending panel portions with different relative angles and speeds, and these angles and speeds can be selected by appropriate positioning of the axes to most favorably complete the folding of the extending panel portions against the tablet. In prior art folders utilizing a single set of blades on one rotor, the flexibility of working with two different sets of folding blades was not present. With separate rotors and blades one of the blades can begin the folding operation and the other of the blades can complete its operations before the first blade has lost contact with the tablet. A clearer understanding and appreciation of the rotary folding mechanism with two rotors may be had in connection with the following example shown in FIGS. 11–21.

Figure 11:
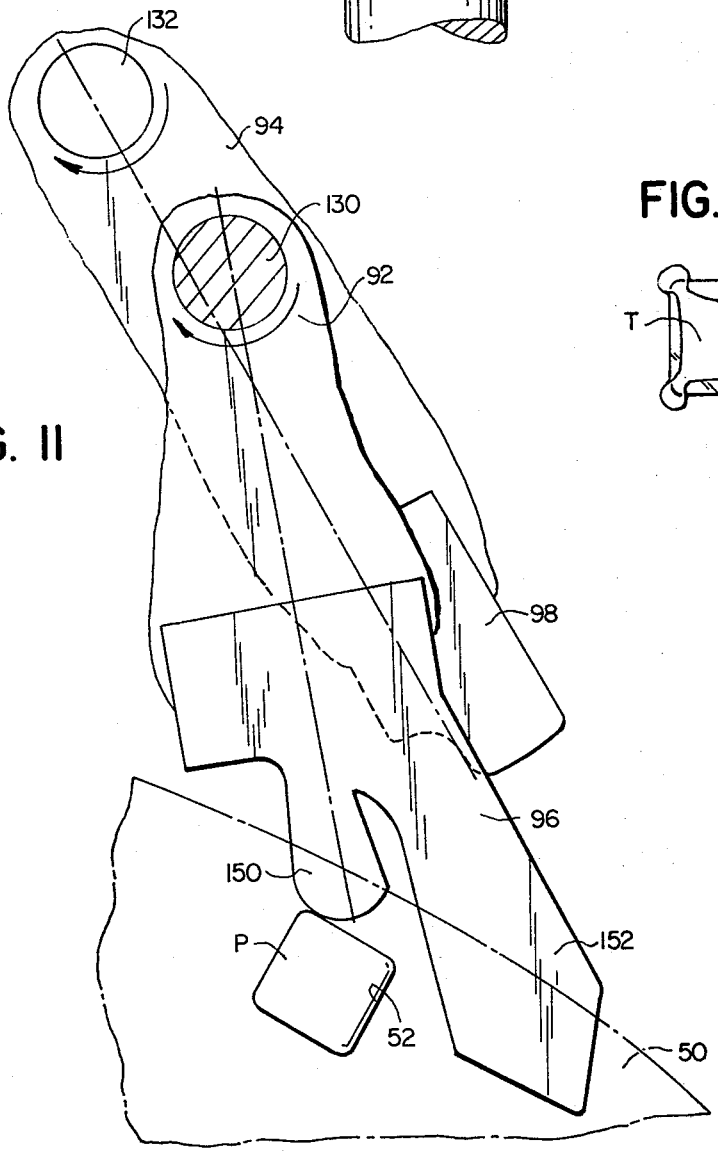
FIGS. 11–20 detail the folding steps performed by one embodiment of the rotary folding mechanism in FIGS. 9 and 10.

In FIG. 11 fragments of the two rotors 92 and 94 are shown with their blades 96 and 98 in a top plan view at the beginning of a folding operation. The wrapper panel P and tablet T are located within an adjacent pocket 52 of the wrapping wheel 50 (in phantom). The blade has a special shape defining a short thumb 150 and elongated finger 152. As shown, the thumb is about to contact the panel portion projecting axially of the rectangular pocket 52 from the outermost edge. It should also be noted that the other folding blade 98 at this point is substantially behind the blade 96 in the direction of rotation.

Figure 12:
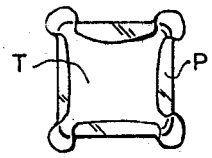

FIG. 12 is a bottom plan view and shows the tablet and wrapper panel in isolation at this stage of the folding operation.

Figure 13:
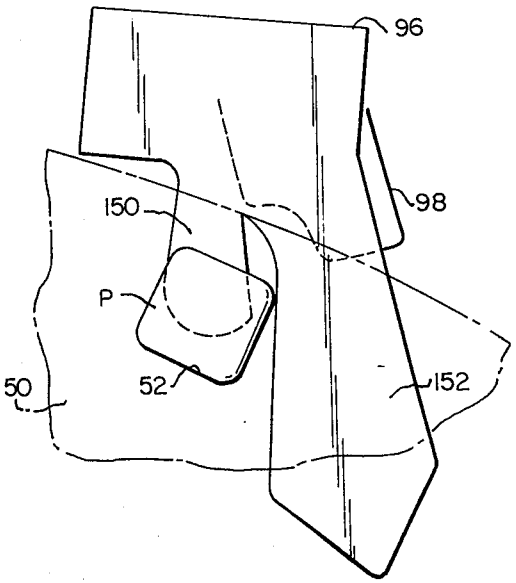

FIG. 13 is a plan view illustrating the folding blades 96 and 98 and the wrapping wheel 50 after each has rotated a few degrees beyond the positions illustrated in FIG. 11. The thumb 150 of the blade 96 is not positioned directly under the tablet T and has tucked the panel portion adjacent the radially outer edge of the pocket 52 against the bottom side of the tablet. The finger 152 is approaching the panel portion adjacent the trailing edge of the pocket 52 which ensures that the panel portion adjacent the edge is not deflected outwardly by the tucking operation performed by the thumb 150. It will also be noted that the second blade 98 has advanced relative to the finger 152 of the blade 96 due to the difference in peripheral speeds of the two blades.

Figure 14:
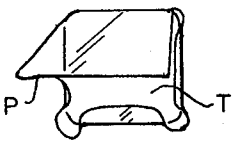

FIG. 14 illustrates the tablet and panel in isolation at this stage of the folding operation.

Figure 15:
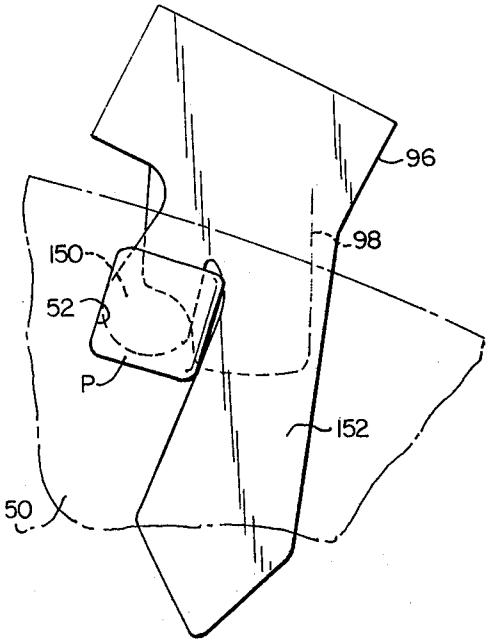
Figure 16:
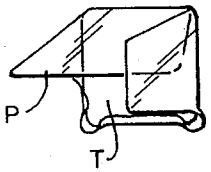

FIG. 15 illustrates the fingers 96 and 98 and the wrapping wheel after several additional degrees of rotation beyond the positions shown in FIG. 13. It will be observed at this point that the second blade 98 has now overtaken the finger 152 due to its higher peripheral speed and, consequently, it has engaged the panel portion extending axially from the trailing edge of the pocket 52 and folded that portion against the tablet. The thumb 150 of the blade 96 remains substantially centered under the tablet due to the almost identical peripheral speeds of the tablet and the blade. FIG. 16 illustrates the condition of the panel portions at this stage of the operation.

Figure 17:
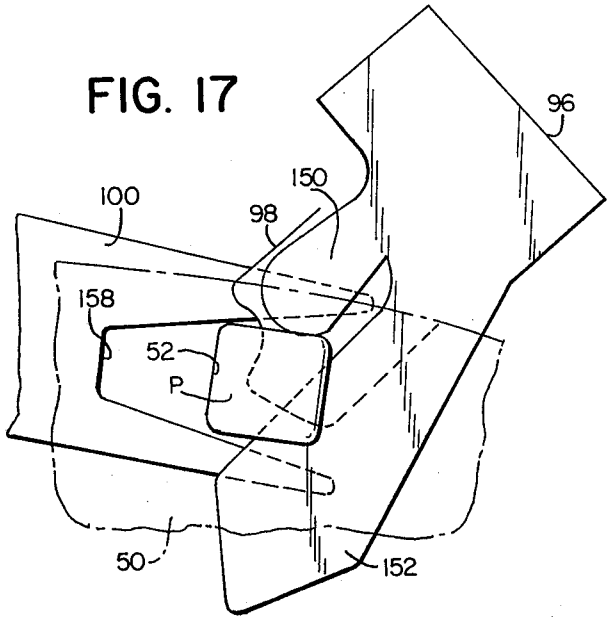
Figure 18:
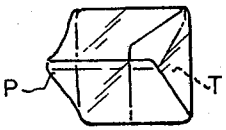

After still further movements of the wrapping wheel 50 and the blades 96 and 98, the folding process reaches the stage illustrated in FIG. 17. At this point, the blade 98 has overtaken the thumb 150 of the blade 96 and the finger 152 has pulled and folded the panel portion adjacent the radially inner edge of the pocket 52 against the tablet. The only remaining panel portion which is not contacted by the blades 96 and 98 is the portion adjacent the leading edge of the pocket 52, and it will be observed that a notch 158 in the stationary last folder blade 100 is about to bend this remaining portion toward the tablet as illustrated most clearly in FIG. 7. At this stage, the tablet and panel appear as shown in FIG. 18.

Figure 19:
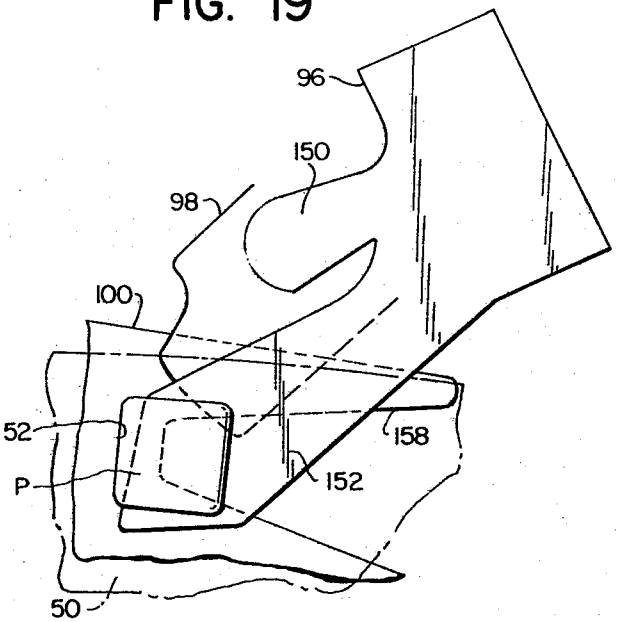
Figure 20:
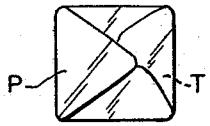

In the final stage of the folding operation shown in FIG. 19, the blade 98 has completed its folding step and the finger 152 of the blade 96 is retaining the previous folds while the root of the notch 158 in the stationary blade 100 has engaged the remaining panel portion adjacent the leading edge of the pocket 52 to fold this portion over the contoured end of the finger 152. It will be observed in FIG. 7 that the stationary blade is tapered at the end containing the notch to provide clearance for the finger 152 as it sweeps radially outward and away from the periphery of the wrapping wheel 50 in FIG. 19. Thus, the notched end of the stationary blade completes the folding operation and envelops the tablet in the wrapper panel as illustrated in FIG. 20. In order to permanently set the folds in the wrapper panel it may be desirable to include a heater underneath the blade 100 and the interconnecting takeout plate 101 to break the "memory" of the initially flat panel.

Figure 8:
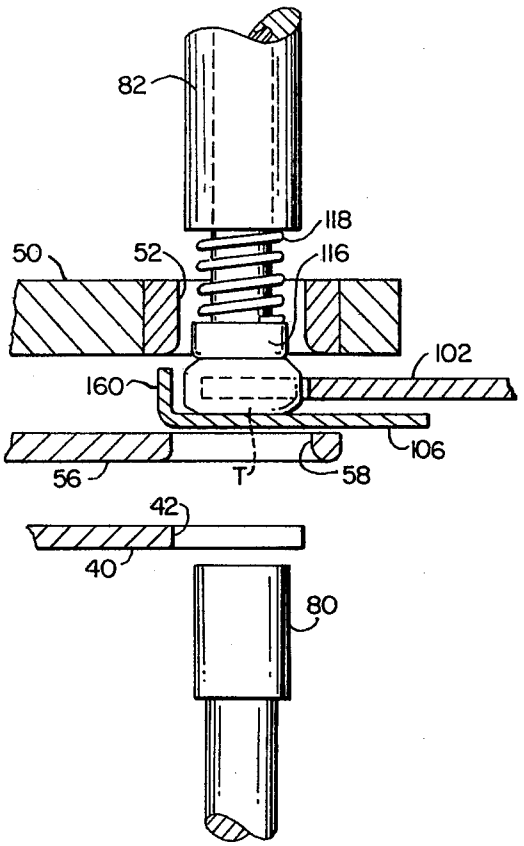

The takeout plate 101 is provided with a ramp leading downward from the blade 100 to a position slightly above the discharge wheel 102 as shown in FIG. 1. As shown in FIG. 8, the upper plunger 82 is cammed downward over the ramp portion of the takeout plate to press the wrapped tablet out of the pocket 52 for engagement by ratchet teeth on the discharge wheel 102 at the discharge end of the ramp. At the end of the ramp, the tablet drops in front of a ratchet tooth and onto the support plate 106 as shown in FIG. 8. A lip 160 formed along the edge of the plate 106 adjacent the radially inner edge of the pocket 52 ensures that the wrapped tablet is pulled away from the wrapping wheel 50 and into the discharge wheel by the ratchet tooth.

Figure 21:
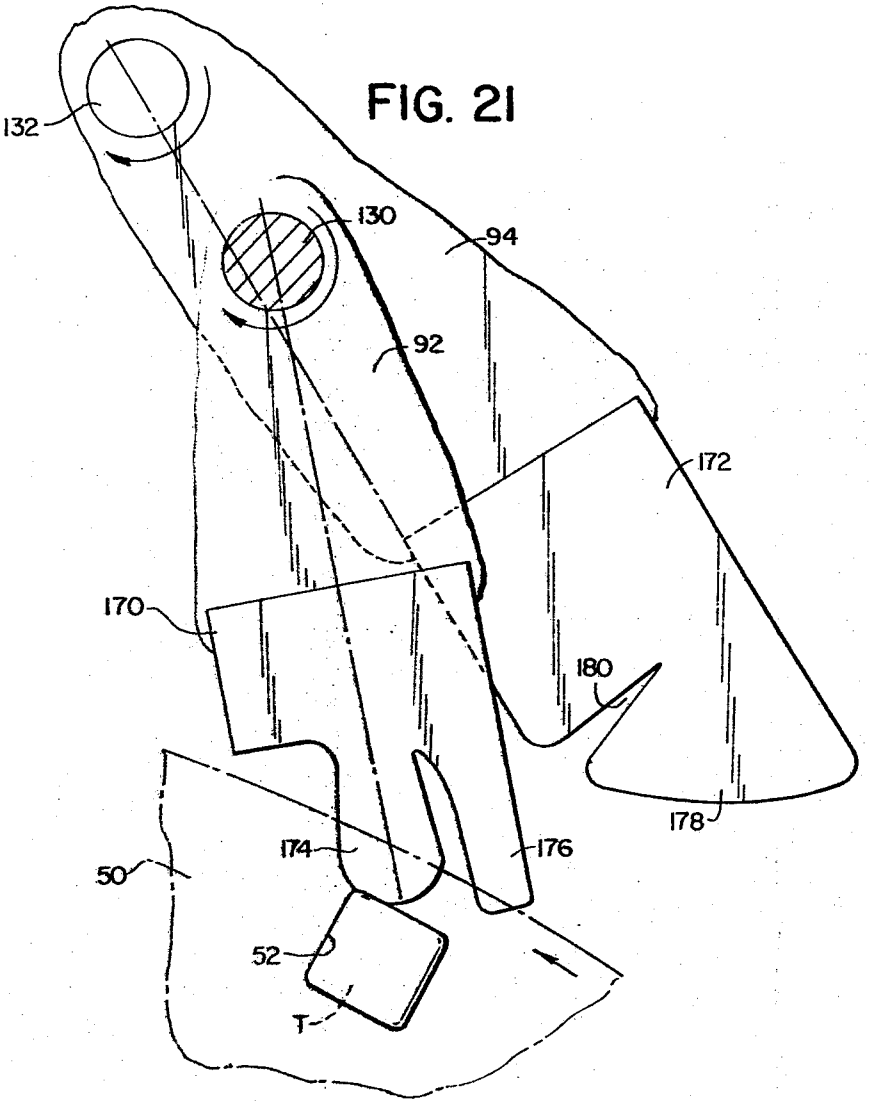
FIGS. 21 and 22 detail the folding steps performed by another embodiment of the rotary folding mechanism.

FIG. 21 illustrates an alternate embodiment of the rotary folding mechanism utilizing blades 170 and 172 which have a slighly different configuration and perform a slightly different folding operation than the blades 96 and 98 previously described. The blade 170 corresponds to the blade 96 in FIG. 11 and has a thumb 174 and a relatively short finger 176. The blade 172 corresponds to the blade 98 in FIG. 11 but includes a triangularly shaped extension 178 on its outer end which forms a notch 180 along the leading edge.

Figure 22:
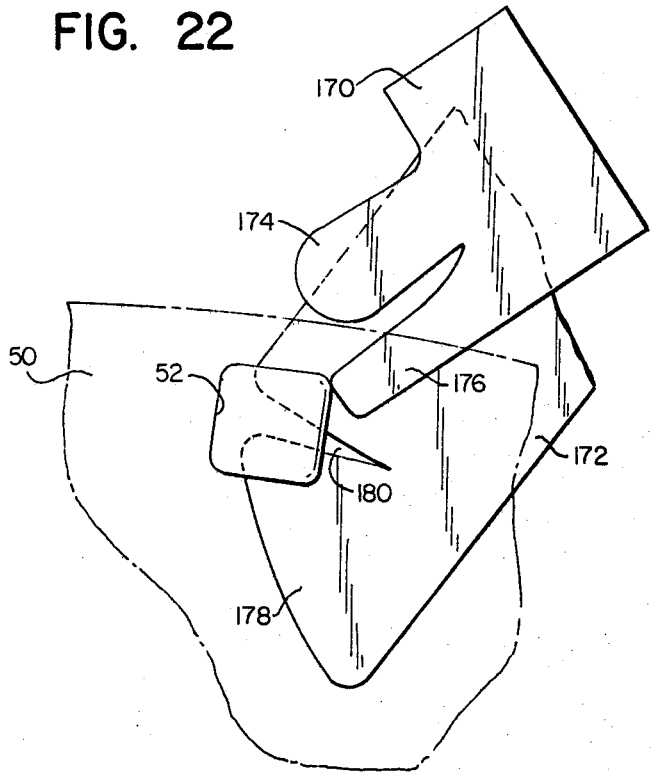

The thumb 174 tucks the panel portion extending axially from the outer edge of the pocket 52 against the tablet T in the same manner as the thumb 150 in FIG. 13 while the finger 176 holds the panel portion at the trailing edge of the pocket. The leading edge of the second blade 172 folds the panel portion projecting from the trailing edge of the pocket 52 in the same manner as the leading edge of the blade 98 in FIG. 15. However, as shown in FIG. 22, the panel portion extending from the radially inner edge of the pocket 52 is captured in the notch 180 of the blade 172 and is pulled and folded against the tablet by the triangular extension 178 due to the higher peripheral velocity of the extension 178 on the blade 172 and the fore-shortened finger 176 on the blade 170. In other words, the extending panel portion adjacent the radially inner edge of the pocket 52 is folded by the second blade 172 rather than the first blade 170.

The two rotors 92 and 94 of the rotary folding mechanism 90 provide the versatility which permits the folding of the various panel portions against the tablet in a single sweep of two folding blades under the pocket of the wrapping wheel 50. The precise location of the axes for each rotor may be varied in conjunction with the blade shapes to establish the proper timing and relative speeds of the blades for tucking and folding panels or flaps around the product.

Thus, a packaging machine has been disclosed in which tablet-type products may be individually wrapped at high speed. Minimal disturbance of the product itself takes place because the motions are continuous throughout the machine. Continuously rotating components such as the rotors of the folding mechanism and the wrapping wheel minimize inertial forces and thusly, allow the wrapping process to take place at high speed.

While the present invention has been described in several preferred embodiments, it should be understood that numerous modifications and substitutions can be had without departing from the spirit of the invention. For example, the product feeding means including the wheels 14, 18 and 30 may be supplemented or reduced in number in accordance with the acceleration forces that can be tolerated by the products. The wrapper feed mechanism may also take various forms as long as the wrapper panels are captured between the product and wrapping wheel for plunging into the peripheral pockets. Various structures may be utilized to support the plunger assemblies for revolution about the axis of the wrapping wheel in positional alignment with the pockets, and means other than the cams may be provided to retract and extend the plungers at appropriate times. Accordingly, the present invention has been described in several embodiments by way of illustration rather than limitation.

We claim:

1. A high speed wrapping machine for individually wrapping tablet-like products comprising:

a rotatable wrapping wheel having a plurality of product-receiving pockets distributed about the periphery of the wheel for receiving the products at one point on the periphery and discharging at another point and continuously moving the products between said points as the wrapping operation is carried out;

a set of plungers associated respectively with each of the peripheral pockets and disposed for revolving movement with the respective pockets at opposite axial sides of the wheel to plunge the products in the axial direction in and out of the pockets as the wrapping wheel rotates;

wrapper feeding means having a feed path for delivering individual wrapper panels to one axial side of the wheel between a respective pocket and one of the plungers;

product feeding means for delivering individual products adjacent said one axial side of the wheel between an individual wrapper panel and one of the plungers whereby the plunger may move the product and wrapper panel axially into a pocket with the wrapper draped over the product and panel portions extending from the pocket at said one side of the wrapping wheel; and rotary folding means positioned adjacent said one side of the rotatable wrapping wheel and including two rotors, each of which carries a plurality of folding blades and which are rotated continuously in one direction about spaced = parallel axes situated radially outward of the periphery of the wrapping wheel, the blades of one rotor being passed over the blades of the other rotor as the blades of both rotors are brought synchronously into contact with the extending panel portions to flatten the panel portions against the products in the pockets.

2. A high speed wrapping machine as defined in claim 1 wherein one of the rotor axes is spaced from the periphery of the wrapping wheel by a greater amount than the other of the rotor axes.

3. A high speed wrapping machine as defined in claim 1 wherein:

the product feeding means comprises a plurality of product accelerating wheels receiving individual products, an accumulating wheel positioned between and tangentially of the wrapping wheel and the accelerating wheels and guide means for transferring the individual products from the accelerating wheels to the accumulating wheel and from the accumulating wheel to the wrapping wheel.

4. A high speed wrapping machine as defined in claim 1 wherein:

the product feeding means includes a retaining wheel mounted coxially at one side of and rotatable with the wrapping wheel and having a plurality of peripheral pockets aligned respectively with the pockets of the wrapping wheel and opening radially of the retaining wheel for radially receiving individual products adjacent the pocket of the wrapping wheel.

5. A high speed wrapping machine as defined in claim 4 further including a wrapper forming disc rotatable with an interposed between the wrapping wheel and the retaining wheel and having a plurality of peripheral apertures axially aligned with the respective pockets in the wrapping and retaining wheels, the apertures being sized and shaped to pull the draped wrapper panels over the product as the plunger moves the product and wrapper axially through the aperture and into the pocket of the wrapping wheel.

6. A high speed wrapping machine as defined in claim 4 wherein the wrapper feeding means has a feed path leading tangentially into the wrapping wheel axially adjacent the peripheral pockets between a point on the periphery of the retaining wheel where the products are received and the rotary folding means whereby a wrapper panel fed along the feed path and a product in a pocket of the retaining wheel may move together axially adjacent a pocket in the wrapping wheel.

7. A high speed wrapping machine as defined in claim 1 further including a product takeout plate extending axially adjacent the wrapping wheel between the wheel and the plungers at one side of the wheel and from the rotary folding means to the point of discharging on the periphery of the wrapping wheel for supporting the products as they are removed from the wrapping wheel.

8. A high speed wrapping machine as defined in claim 1 wherein a stationary folding blade adjacent the rotary folder cooperates with the rotary folder in folding the extending panel portions against the product.

9. A high speed rotary folder for a wrapping machine comprising:

a wrapping wheel rotatable about the central wheel axis and having a plurality of product-receiving pockets distributed about the periphery of the wheel, each pocket having an axis extending parallel to the central wheel axis and having an opening for axially receiving the product draped in a panel of wrapping material, the sides of the pocket being selected to hold the product and bend the draped panel over the held product with panel portions extending axially from the pocket;

rotary means adjacent the periphery of the wrapping wheel and cooperating with the wrapping wheel for tucking and folding the extending panel portions against the product, the rotary means including first and second rotors positioned closely adjacent and parallel to the wrapping wheel, the two rotors having spaced, parallel axes of rotation located outside the periphery of the wrapping wheel and the pockets therein and carrying a plurality of folding blades which are wiped in a continuous motion in one direction across the panel portions extending from the pockets with the blades of one rotor passing respectively over the blades of the other rotor in a tucking and folding operation; and synchronous drive means connected with the rotors and the wrapping wheel for rotating the rotors and wheel in continuous and synchronized relationship to tuck and fold the extending panel portions against the product.

10. A high speed rotary folder as defined in claim 9 wherein:

the axis of rotation of the first rotor is spaced farther from the wheel axis than the axis of rotation of the second rotor, and the axes of rotation are spaced from the wheel axis by amounts bringing the tips of the blades of the respective rotors into engagement with the panel portions extending from the wrapping wheel.

11. A high speed rotary folder as defined in claim 10 wherein said axes of the rotors lie along different radials from the wheel axis.

12. A high speed rotary folder as defined in claim 10 wherein:

the axis of the second rotor is situated farther from the wheel axis than the axis of the first rotor; and the synchronous drive means rotates the two rotors at the same rotational speed, whereby the tips of the blades on the second rotor move in engagement with the extending panel portions at a higher speed than the tips of the blades on the first rotor.

13. A high speed rotary folder as defined in claim 10 wherein:

the pockets of the wrapping wheel are rectangular pockets which define four panel portions extending from the four respective sides of each rectangular pocket holding a product draped by a panel of wrapping material;

each one of the folding blades on the first rotor is shaped and positioned to fold two of the four panel portions against the product held in a pocket; and the folding blades on the second rotor are shaped and positioned to fold one of the other panel portions against the product.

14. A high speed rotary folder as defined in claim 10 wherein:

the pockets of the wrapping wheel are rectangular pockets which define four panel portions extending from the four respective sides of each rectangular pocket holding a product draped by a panel of wrapping material;

each one of the folding blades on the first rotor is shaped and positioned to fold one of the four panel portions against the product held in a pocket; and each one of the folding blades on the second rotor is shaped and positioned to fold two of the other panel portions against the product.

15. A high speed rotary folder as defined in claim 9 further including a stationary final folding blade situated along the periphery of the wrapping wheel immediately following the first and second rotors in the direction of movement of the products held in the pockets, the final folding blade being located directly under the path followed by the pockets.

16. A high speed rotary folder as defined in claim 15 wherein the final folding blade is connected with a takeout plate leading from the wrapping wheel.

17. A high speed wrapping machine as defined in claim 1 wherein the rotary folding means includes a bladed rotor positioned relative to the periphery of the wrapping wheel and having a blade shaped to engage a wrapper panel portion extending from the radially inner side of the pocket for folding said extending panel portion radially outwardly against the product.

18. A high speed rotary folder as defined in claim 9 wherein: the at least one of the folding blades on one of the rotors is shaped and positioned to pull a panel portion adjacent the radially inner side of the pocket outwardly as the rotors and wrapping wheel rotate.

* * * * *

UNITED STATES PATENT OFFICE

CERTIFICATE OF CORRECTION

Patent No. 4,085,567 Dated April 25, 1978

Inventor(s) Alfred D'Antonio, Roger L. Putnam, Jr., Richard H. Provost,

It is certified that error appears in the above-identified patent and that said Letters Patent are hereby corrected as shown below:

Column 1, line 26, "protions" should be --portions--.

Column 5, line 30, "relese" should be --release--.

Column 11, line 15, after "spaced" delete -- = --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*